United States Patent [19]

van der Goot et al.

[11] 3,974,416

[45] Aug. 10, 1976

[54] MULTIPLE ELECTRODE SUPPORT MEMBERS WITH LOW COEFFICIENT OF EXPANSION

[75] Inventors: Antonie Sijtze van der Goot; Peter Hermans, both of Eindhoven, Netherlands

[73] Assignee: U.S. Philips Corporation, New York, N.Y.

[22] Filed: Mar. 19, 1975

[21] Appl. No.: 559,740

[30] Foreign Application Priority Data

Apr. 1, 1974 Netherlands ..... 7404365

[52] U.S. Cl. ..... 313/417; 313/451

[51] Int. Cl.[2] ..... H01J 29/02; H01J 29/51; H01J 29/82

[58] Field of Search ..... 313/417, 447, 409, 411

[56] References Cited

UNITED STATES PATENTS

| | | | |
|---|---|---|---|
| 2,135,941 | 11/1938 | Hirmann | 313/447 X |
| 3,501,668 | 3/1970 | Pappadis | 313/417 X |
| 3,628,077 | 12/1971 | Bossers | 313/447 |
| 3,838,306 | 9/1974 | Jenne | 313/417 X |
| 3,895,253 | 7/1975 | Schwartz et al. | 313/414 X |

*Primary Examiner*—Robert Segal

*Attorney, Agent, or Firm*—Frank R. Trifari; George B. Berka

[57] ABSTRACT

An electron gun assembly for generating a plurality of converging electron beams wherein at least one control electrode is supported eccentrically relative to the tube axis by a supporting member having a coefficient of linear expansion lower than $80.10^{-7}/°C$.

4 Claims, 3 Drawing Figures

MULTIPLE ELECTRODE SUPPORT MEMBERS WITH LOW COEFFICIENT OF EXPANSION

Figure 1:
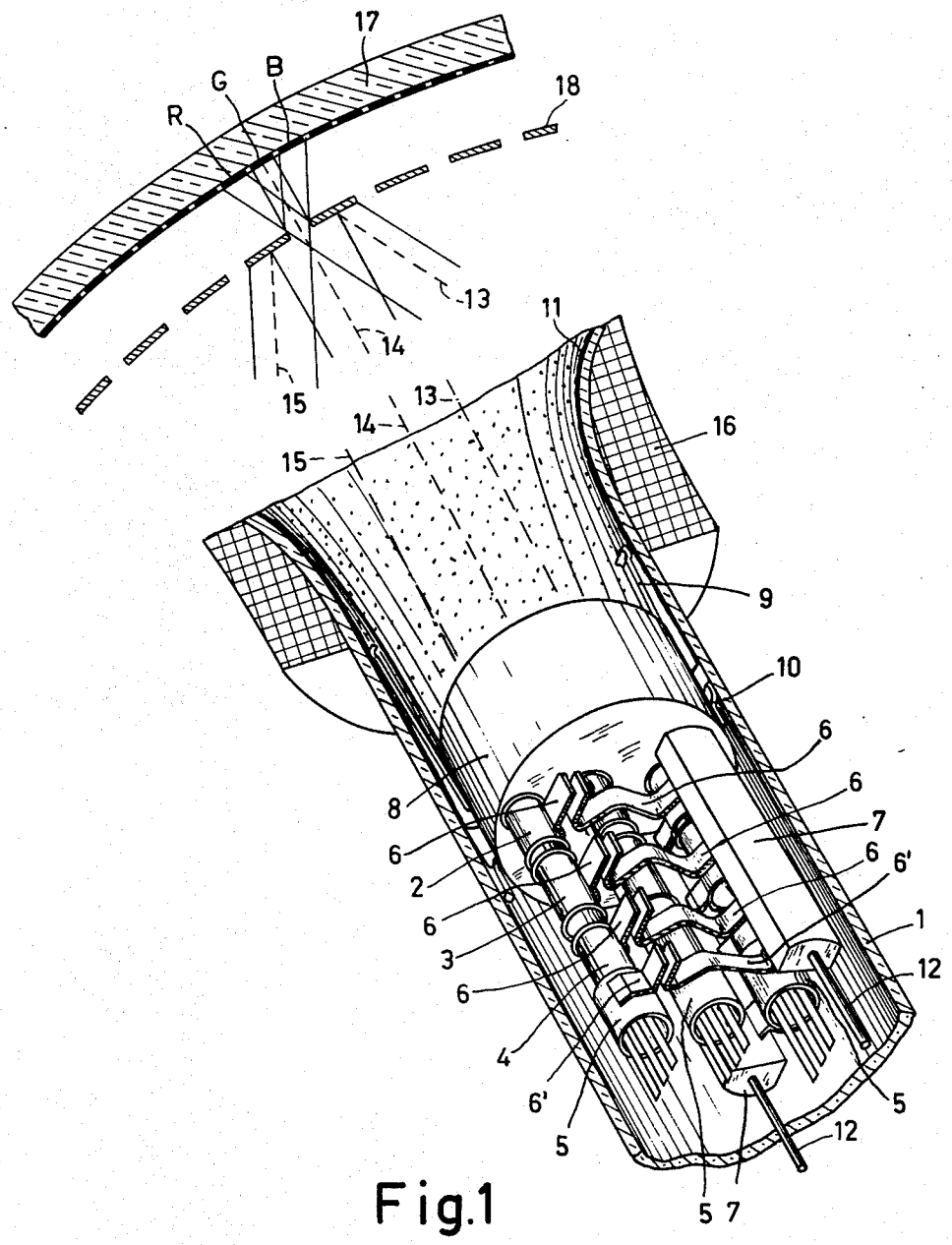

The invention relates to a cathode-ray tube for displaying coloured pictures and comprising in an evacuated envelope means to generate at least two electron beams, which means comprise at least one electrode having an aperture for passing an electron beam and being situated eccentrically with respect to the tube axis.

Such cathode-ray tubes are known. The means for generating the electron beams may consist either of an assembly of individual electron guns assembled to form a unit, or may consist of an assembly of electron guns in which certain corresponding electrodes form an integral construction. Corresponding electrodes are to be understood to mean herein those electrodes which have a corresponding function for the formation of the electron beams.

The electron beams are directed onto a display screen on which substances luminescing in different colours are provided according to a given pattern in such manner that each electron beam is associated with luminescent regions of one colour. The axes of the electron beams converge in the direction towards the display screen and intersect each other substantially in one point at the area of the display screen. The colour selection is obtained in known manner by means of a perforated plate, so-called shadow mask or colour selection electrode, mounted in the tube at a short distance from the display screen.

Several possibilities are known for the convergence of the electron beams. For example, the convergence can be effected entirely by means of electric and/or magnetic fields. Another possibility is that the desired convergence is obtained partly by a converging position of the electron guns themselves, while the said convergence is completed to the desired convergence by means of electric and/or magnetic means.

With the means as stated in the above-mentioned Examples the "static convergence" can be adjusted, i.e. the convergence of the electron beams when same are directed on the centre of the display screen. Upon scanning the display screen, the convergence of the electron beams should be adapted to the place where said beams impinge upon the display screen, also due to the slight curvature thereof. The correction required for that purpose is sometimes referred to as "dynamic convergence". It will be obvious that a good colour reproduction is out of the question in the case of an incorrect convergence, because in that case the luminescent regions hit by the electron beams do not form a correct combination.

Applicants have found that the known cathode-ray tubes do not always give satisfactory results. It has been found notably that the convergence of the electron beams, varies in time after putting the tube into operation, notwithstanding a correct adjustment of the static and dynamic convergence.

It is the object of the invention to provide a cathode-ray tube for displaying coloured pictures in which said undesired effect occurs to a considerably smaller extent.

According to the invention, a cathode-ray tube of the type mentioned in the preamble is characterized in that the eccentricity of an aperture in an electrode relative to the tube axis is determined by a material the coefficient of linear expansion of which is lower than $80.10^{-7}/°C$.

The invention is based on the recognition resulting from investigations that the variation of the convergence of the electron beams is caused by a variation in a location of an aperture which is present in an electrode and is eccentric relative to the tube axis, which variation occurs as a result of thermal effects, said aperture serving to pass an electron beam. The convergence drift thus caused is associated with a displacement of the spot formed on the display screen by the relevant electron beam.

In the case in which the means for generating the electron beams consists of an assembly of individual electron guns assembled to form a unit, it is usual to fix the position of the electrodes composing a gun by means of a number of supporting members which are secured at one end to the said electrodes and are secured at the other end in assembly members consisting of electrically insulating material. A displacement of an electrode relative to the tube axis as a result of a thermal expansion of the said supporting members is considerably reduced if, according to the invention, said supporting members consist of a material the coefficient of linear expansion of which is lower than $80.10^{-7}/°C$. In other words, the eccentricity of an aperture present in said electrode is determined relative to the tube axis by a material the coefficient of linear expansion of which is lower than $80.10^{-7}/°C$.

It is not necessary to manufacture all the supporting members from a material having a low coefficient of expansion. It is already sufficient to take said measures for those electrodes which are present at a very short distance from the cathodes to be operated at a high temperature. Consequently, according to the invention, the supporting members of the control electrodes preferably consist of a material the coefficient of linear expansion of which is lower than $80.10^{-7}/°C$.

Non-limiting examples of materials which are suitable for the object underlying the present invention are alloys of iron and nickel containing 30 to 40% by weight of nickel and alloys of mainly iron, nickel and cobalt containing 28 to 30% by weight of nickel and 16 to 20% by weight of cobalt.

Figure 2:
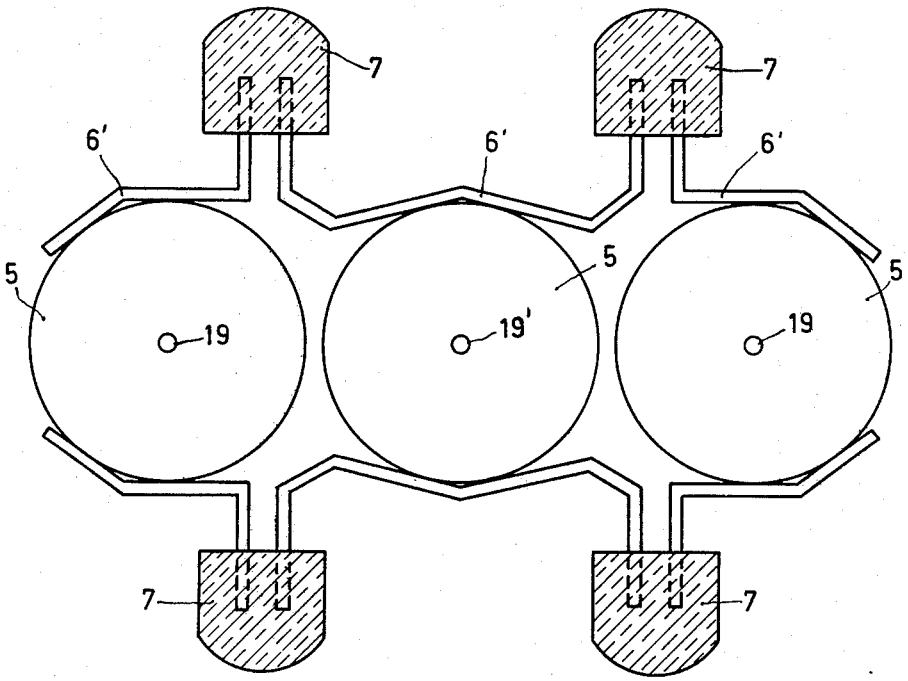
Figure 3:
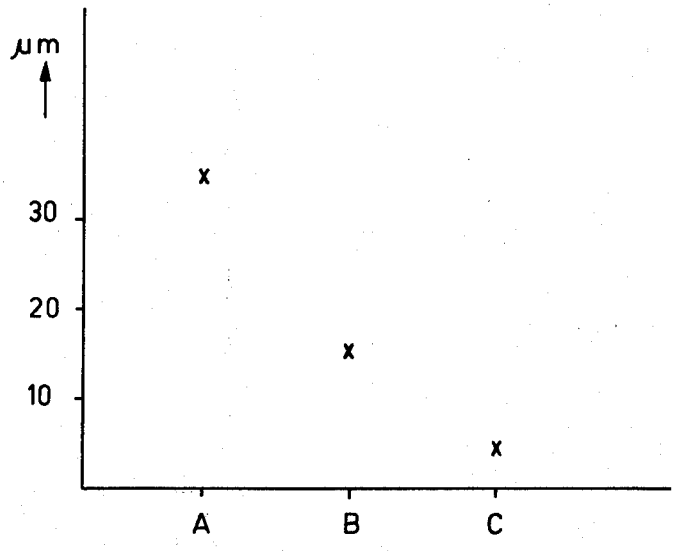

The invention will be described in greater detail with reference to the drawing, in which:

FIG. 1 shows an assembly of three electron guns according to the invention accommodated in a cathode-ray tube the envelope of which is shown only partly, FIG. 2 is a plan view of an assembly of control electrodes as shown in FIG. 1, and FIG. 3 shows for three comparable cases the displacement of the outer control electrodes relative to the intermediate control electrode at a temperature variation of 20°C to approximately 200°C.

FIG. 1 shows the neck portion and a part of the display screen of a cathode-ray tube according to the invention. Present in the neck 1 is an assembly of three electron guns for generating three electron beams the axes 13, 14 and 15 of which are located in one plane. Each gun comprises an acceleration electrode 2, a focusing electrode 3, an anode 4 and a control electrode 5 centred along one axis. An indirectly heated cathode of which only the supply conductors are visible in the drawing, is mounted within each control electrode so as to be electrically insulated therefrom. The assembly of electron guns is centred in the neck of the tube by means of a centring cylinder 8 secured to the electrodes 2 and having two contact springs 9 and three centring springs 10. The contact springs 9 contact an electrically conductive layer 11 provided on the interior of the tube wall, while the centring springs also serve as damping springs to avoid microphony. The assembly is secured to a number of pins sealed in the sealing plate of the neck by means of connection pins 12 which are sealed in glass assembly members 7. The said sealing plate, not shown in the drawing, also comprises the lead-through pins for the electric connection of the various electrodes. Each electrode has supporting members 6, 6' the free ends of which are sealed in the above-mentioned assembly members 7. Totally four of such assembly members are used but only two of them are shown in the drawing for reasons of clarity.

Up to now it has been usual to manufacture all supporting members, including those of the control electrodes, from chromium-nickel steel. An alloy containing approximately 18% by weight of chromium, 12% by weight of nickel and 70% by weight of iron was used for that purpose due to its non-magnetic properties. It has been found, however, that the use of chromium-nickel steel supporting members results in an unacceptable convergence drift of the electron beams after putting the tube into operation. It has been found experimentally that in a cathode operated at a temperature of approximately 800°C the temperature of the supporting members of the control electrodes can increase to approximately 200°C. The consequently occurring thermal expansion of the supporting members results in a displacement of the outer control electrodes relative to the intermediate control electrode. In order to reduce said displacement, the supporting members 6' with which the control electrodes 5 are fixed, consist of an alloy of iron and nickel containing 36% by weight of nickel. Such an alloy which is commercially available as Invar has a coefficient of linear expansion of approximately $20.10^{-7}$/°C as against a coefficient of linear expansion of approximately $160.10^{-7}$/°C of the above-mentioned chromium-nickel steel. The other supporting members 6 may consist of chromium-nickel steel due to their larger distance to the cathode.

It is shown in the drawing how the electron beams impinge upon the display screen 17 in the case of correct convergence. The axes 13, 14 and 15 of the electron beams intersect each other in substantially one point on the display screen 17. The colour selection is obtained by a shadow mask 18 mounted in the tube at a short distance from the display screen. The beams passed through by the shadow mask impinge upon a combination of phosphor regions which luminesce in the colours red, green and blue and are denoted by R, G and B. These phosphor regions are provided on the display screen according to a pattern of lines and are successively hit by the electron beams, a system 16 of coils arranged coaxially around the tube axis and shown diagrammatically in the drawing ensuring a deflection of the electron beams in two mutually perpendicular directions.

The invention appears to full advantage in an assembly of guns as described above but it is by no means restricted to it. The invention may also be used in assemblies in which the electron guns form a configuration other than that described above, for example, that in which the guns are placed at the corners of an equilateral triangle.

FIG. 2 is a plan view of the assembly of control electrodes as it forms part of the assembly of guns shown in FIG. 1. The supporting members 6' are spot-welded to the control electrodes 5 while the free ends of said supporting members are sealed in the four glass assembly members 7. The displacement of the outer electrodes relative to the intermediate electrode has been measured for a number of comparable cases in which the supporting members 6' consisted of a different material in each of the cases. The results of said measurements are shown in FIG. 3. On the vertical axis is plotted the displacement in $\mu$m of an aperture 19 in an outer electrode 5 relative to the aperture 19' of the central electrode. The measurements have been performed for three cases, namely A, B and C, in which in case A the supporting members consist of chromium-nickel steel having a coefficient of expansion of approximately $160.10^{-7}$/°C; in case B of an alloy of iron, nickel and cobalt containing 28 to 30% by weight of nickel and 18 to 20% by weight of cobalt and having a coefficient of expansion of approximately $50.10^{-7}$/°C, and in case C of an alloy of iron and nickel containing 36% by weight of nickel and having a coefficient of expansion of approximately $20.10^{-7}$/°C. After the supporting members have assumed a temperature of approximately 200°C, the displacement of the outer electrodes relative to the central electrode is on an average 35 $\mu$m in case A, 15 $\mu$m in case B and 4.5 $\mu$m in case C. The corresponding displacement of the spot of the electron beams on the display screen proves to be approximately a factor 10 larger, which for case A comes down to a displacement of 0.35 mm, which is unacceptable. The best results are obtained when the supporting members 6' consist of the above-mentioned iron-nickel alloy which is commercially available as Invar.

What is claimed is:

1. A color cathode ray tube comprising, in an evacuated envelope, means to generate at least two electron beams, said means comprising a number of electrodes including at least one control electrode having an aperture situated eccentrically relative to the tube axis for passing an electron beam to a convergence point, supporting members for securing said electrodes in a predetermined space relationship and having free ends secured in assembly members consisting of electrically insulating material, the eccentricity of said at least one control electrode aperture being determined by supporting means having a coefficient of linear expansion less than $80.10^{-7}$/°C.

2. A cathode-ray tube as claimed in claim 1 wherein the said material having a low coefficient of linear expansion consists of an alloy of iron and nickel containing 30 to 40% by weight of nickel.

3. A cathode-ray tube as claimed in claim 1 wherein the said material having a low coefficient of expansion consists of an alloy of iron, nickel and cobalt containing 28 to 30% by weight of nickel and 18 to 20% by weight of cobalt.

4. A cathode-ray tube as claimed in claim 1, and comprising in an evacuated envelope means to generate three electron beams the axes of which are situated substantially in one plane.

* * * * *